US007526896B1

(12) United States Patent
Lohmeyer et al.

(10) Patent No.: US 7,526,896 B1
(45) Date of Patent: May 5, 2009

(54) APPARATUS AND METHOD FOR PROTECTING WINDOWS FROM HIGH WINDS

(75) Inventors: Mike Lohmeyer, Safety Harbor, FL (US); Frank Leko, Safety Harbor, FL (US)

(73) Assignee: Florida Hurricane Clamp, Inc., Safety Harbor, FL (US)

( * ) Notice: Subject to any disclaimer, the term of this patent is extended or adjusted under 35 U.S.C. 154(b) by 29 days.

(21) Appl. No.: 11/974,052

(22) Filed: Oct. 11, 2007

Related U.S. Application Data

(63) Continuation-in-part of application No. 11/509,393, filed on Aug. 24, 2006.

(60) Provisional application No. 60/765,131, filed on Feb. 3, 2006.

(51) Int. Cl.
*E06B 3/26* (2006.01)

(52) U.S. Cl. ..... 52/202; 52/741.3; 49/50

(58) Field of Classification Search ..... 52/106, 52/202, 203, 204.61, DIG. 12, 741.3; 109/49.5, 109/78, 79; 49/50, 56, 57, 463, 61, 62, 63
See application file for complete search history.

(56) References Cited

U.S. PATENT DOCUMENTS 5,341,860 A * 8/1994 Klein ..... 150/165
5,623,791 A * 4/1997 Schwarz ..... 52/107
5,661,935 A * 9/1997 Erickson et al. ..... 52/202
5,941,031 A * 8/1999 Fullwood ..... 52/202
6,263,625 B1 * 7/2001 LaPointe ..... 52/202
6,293,059 B1 * 9/2001 Goodwin ..... 52/202
6,341,455 B1 * 1/2002 Gunn ..... 52/202
6,393,777 B1 * 5/2002 Renfrow ..... 52/202
6,502,355 B1 * 1/2003 Bori ..... 52/202
6,978,579 B1 * 12/2005 Trinca ..... 52/203

* cited by examiner

*Primary Examiner*—Robert J Canfield
*Assistant Examiner*—Matthew J Gitlin
(74) *Attorney, Agent, or Firm*—Stanley M. Miller

(57) ABSTRACT

A window mounted in recessed relation to an exterior wall of a structure is protected from high winds by a sheet of protective material having a height and width greater than a height and width of a window opening. An "L"-shaped bracket has a base and an arm formed integrally with one another. The base overlies the exterior wall and the arm overlies a vertical sidewall perpendicular to the plane of the window. The arm is secured by a pull pin that may be removed by occupants inside the structure if escape from the structure is required. A threaded stud extends from the base and a wing nut engages the threaded stud and secures a clamp against the sheet of protective material. In a preferred embodiment, the protective material is a high impact plastic.

8 Claims, 3 Drawing Sheets

APPARATUS AND METHOD FOR PROTECTING WINDOWS FROM HIGH WINDS

CROSS-REFERENCE TO RELATED DISCLOSURES

This invention is a continuation-in-part of and claims the benefit of pending U.S. patent application Ser. No. 11/509,393, entitled Apparatus And Method For Protecting Windows From High Winds, filed Aug. 24, 2006 by the same inventors. That disclosure is incorporated by reference in its entirety into this application. This invention also claims the benefit of the earlier filing date of U.S. provisional application No. 60/765,131, filed by the same inventors on Feb. 3, 2006 entitled Plywood Clamp for Storm Window Protection.

BACKGROUND OF THE INVENTION

1. Field of the Invention

This invention relates, generally, to an apparatus and method for protecting windows during storms. More particularly, it relates to an apparatus and method for securing a sheet of high impact plastic in protecting relation to a window.

2. Description of the Prior Art

Plywood is commonly used as a window-protector during high winds. Typically, a sheet of plywood is cut so that it is larger than a window to be protected so that the plywood can be nailed in overlying relation to an exterior frame that surrounds the window.

One drawback of this well-known use of plywood is that the installation procedure must be completed in full for each storm. Coupling the fact that hurricanes sometimes change course and the fact that the plywood-installation job is laborious, most people wait for the last minute before beginning installation and sometimes they wait too long.

Another drawback is that wind can rip the plywood away from the window because nails often lack holding power. The wind flows over the plywood, like air flowing over an aircraft wing, and lifts it from the window.

Still another drawback is the fact that the plywood piece for each window is quite large since it must engage the exterior frame around the window. It is hard to store many pieces of large plywood year after year so many people wastefully discard used sheets and re-purchase new sheets each hurricane season.

The holes left in the exterior frame around the window after a sheet of plywood is removed therefrom are unsightly. Thus there is a need for a window protection system that does not leave unsightly scars behind when it is not in use.

Plywood is also heavy and therefore can be difficult to work with. Thus there is a need for a window protection system that uses light-in-weight material.

Plastic is lighter in weight than plywood and can also be manufactured in durable form such as high impact plastic. However, the cam-over-center clamps of the parent disclosure do not work as well with plastic as they do with plywood. Thus there is a need for a system that employs plastic as a protective material but which uses clamps that are highly compatible with plastic.

An improved apparatus and method would eliminate the need for plywood and would not require that the job be performed from scratch for each storm. The improved apparatus and method would enable the use of high impact plastic or similar material to be used as the window protection material and would provide clamps that do not damage the plastic.

There is also a need for an improved apparatus that maintains the pull pen of the parent disclosure so that occupants of a structure can remove the window-protecting material from inside the structure if a need arises to use a window to escape from the structure.

A further need exists for an improved bracket for holding the protective material. The improved bracket would have few parts and require less material to manufacture than the bracket of the parent disclosure.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved method of protecting windows from the effects of high winds is now met by a new, useful, and nonobvious invention. The novel apparatus and method protects a window that is mounted in a window opening in recessed relation to an exterior surface of a structure. The window opening includes a pair of opposed vertical sidewalls that are positioned in a plane perpendicular to the plane of the glass of the window, on an exterior side of the window.

A sheet of protective material that does not break upon being subjected to high winds is dimensioned so that it has a height and width at least slightly greater than a height and width of the window opening. The sheet is held in closing relation to the window opening with novel brackets and clamps.

At least one hole is drilled into each vertical sidewall of the window opening and a liner having a lumen is inserted into each of the holes. A pull pin has a stem that is inserted into the lumen of the liner and a radially extending flange is formed in the trailing end of the stem. A handle for rotating the pull pin is integrally formed with the flange and shares a common longitudinal axis with the stem.

The invention includes a bracket that takes the positive wind load from the window frame to the exterior wall of the structure. A clamp secures the sheet of plastic to the bracket and the bracket is pressed against the exterior wall of the structure at each location of a clamp.

The novel bracket is "L"-shaped and includes a straight base that abuts and overlies an exterior wall of the structure. An arm is formed integrally with the base and extends from a first end of the base at a ninety degree (90°) angle to the base. The arm abuts and overlies a recessed vertical sidewall of the window opening. An externally threaded stud projects from the base in perpendicular relation thereto.

The novel clamp is formed by a sleeve and a cap that are formed integrally with one another and that have a common central bore formed in them for receiving the threaded stud. The sheet of plastic protective material is apertured at each threaded stud location and each aperture has a diameter slightly greater than the diameter of the sleeve but substantially less than the diameter of the cap.

The cap has a dome shape with concentric rings of steps formed in it so that the radially innermost annular step is spaced further from the sheet of plastic than the radially outermost step. This concentric ring of steps provides flexibility to the cap so that it may flex during high winds without breaking. A flat is formed in the top of the cap, radially inwardly of the radially innermost ring of steps.

The threaded stud has a length or height greater than the length of the common bore formed in the clamp. A wing nut screwthreadedly engages the threaded stud and bears against the flat part of the cap when advanced. Tightening the wing nut thus tightens the clamp and thus engages the plastic sheet of protective material tighter to the bracket. Any other type of nut will perform the same function but a manually-engageable wing nut is preferred over a tool-engageable nut.

Significantly, the novel cap can flex due to the concentric rings of steps formed therein. Moreover, the cap does not move relative to the surface of the plastic as the cap is tightened, thereby preventing damage to the plastic. The large surface area of the cap also ensures that the pressure applied by advancing the wing nut is evenly spread out over said area, thereby further ensuring against damage to the plastic.

After a storm has passed, the wing nut and the one piece sleeve and cap are unsleeved from the threaded stud. The sheet of plastic is then removed. The pull pin is disengaged from the liner that is permanently affixed to the window frame and the "L"-shaped bracket is removed.

In a typical installation, there are four of such clamps for each sheet of plastic material, there being a first vertically spaced apart pair of clamps on a left side of a window opening and a second vertically spaced apart pair on a right side of said window opening.

The bracket therefore relieves all stress from the window.

The novel apparatus and method thus provides an improved method for installing a sheet of high impact plastic or other protective material in protective relation to a window. Unlike conventional installation that leaves holes in an exterior wall after a sheet of protective material is removed therefrom, the novel window protection system does not leave any holes in said exterior wall.

Another advantage of the improved apparatus and method is that it does not require that the job be performed from scratch for each storm. Still another advantage is that the improved apparatus and method prevents wind-removal of the protective material because the lift applied to the plastic sheet cannot overcome the high strength of the screwthreaded attachment of said sheet.

An important object of the invention is to provide an apparatus and method for protecting windows during storms with sheets of high impact plastic instead of plywood.

A closely related object is to provide an apparatus that can clamp plastic sheets very tightly without damaging said plastic sheets.

Another important object is to provide an apparatus having simple brackets and clamps so that the apparatus' can be installed and uninstalled quickly.

Still another important object is to provide an apparatus that does not require that the installation process begin at the very beginning each time the apparatus is installed.

These and other objects and advantages of the invention will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
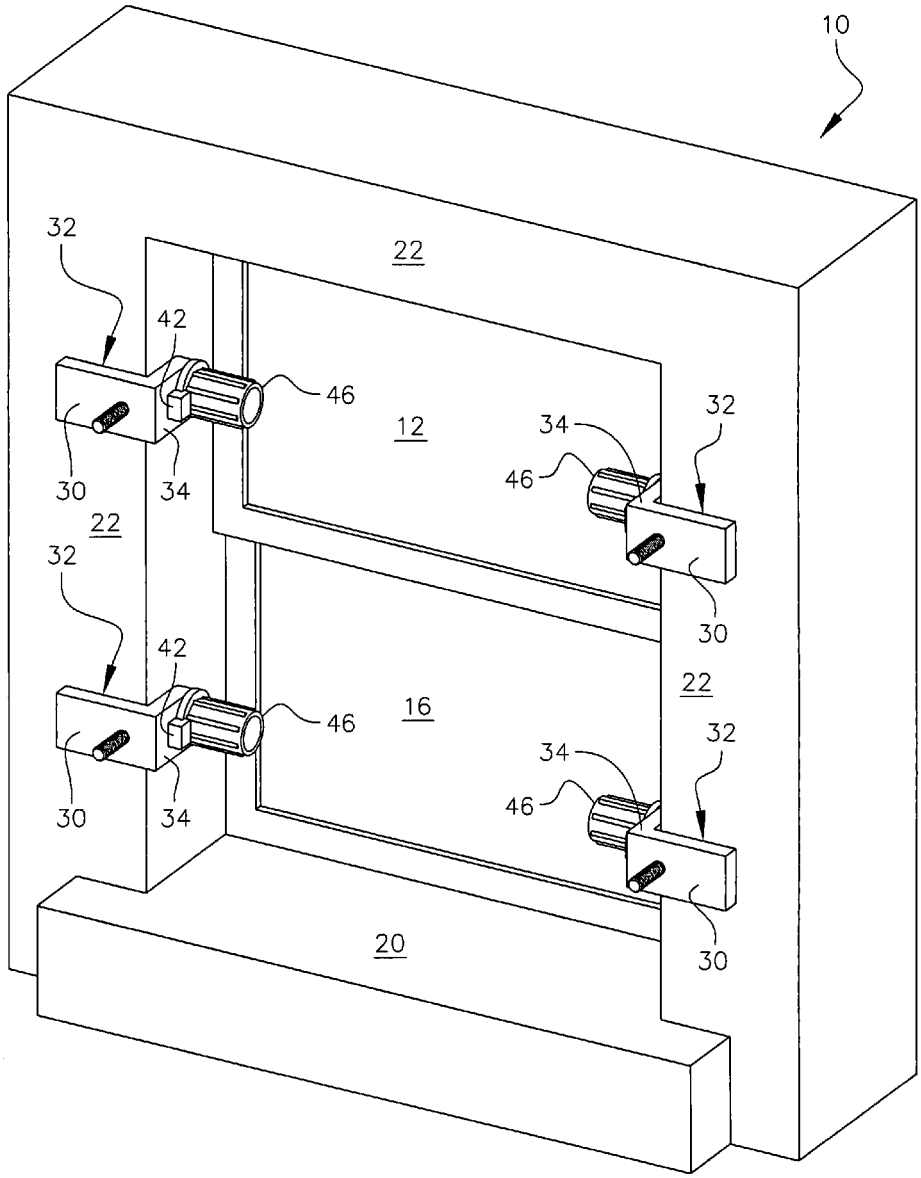
FIG. 1 is a perspective view depicting the novel "L"-shaped brackets having threaded studs in their respective functional positions.
Figure 2:
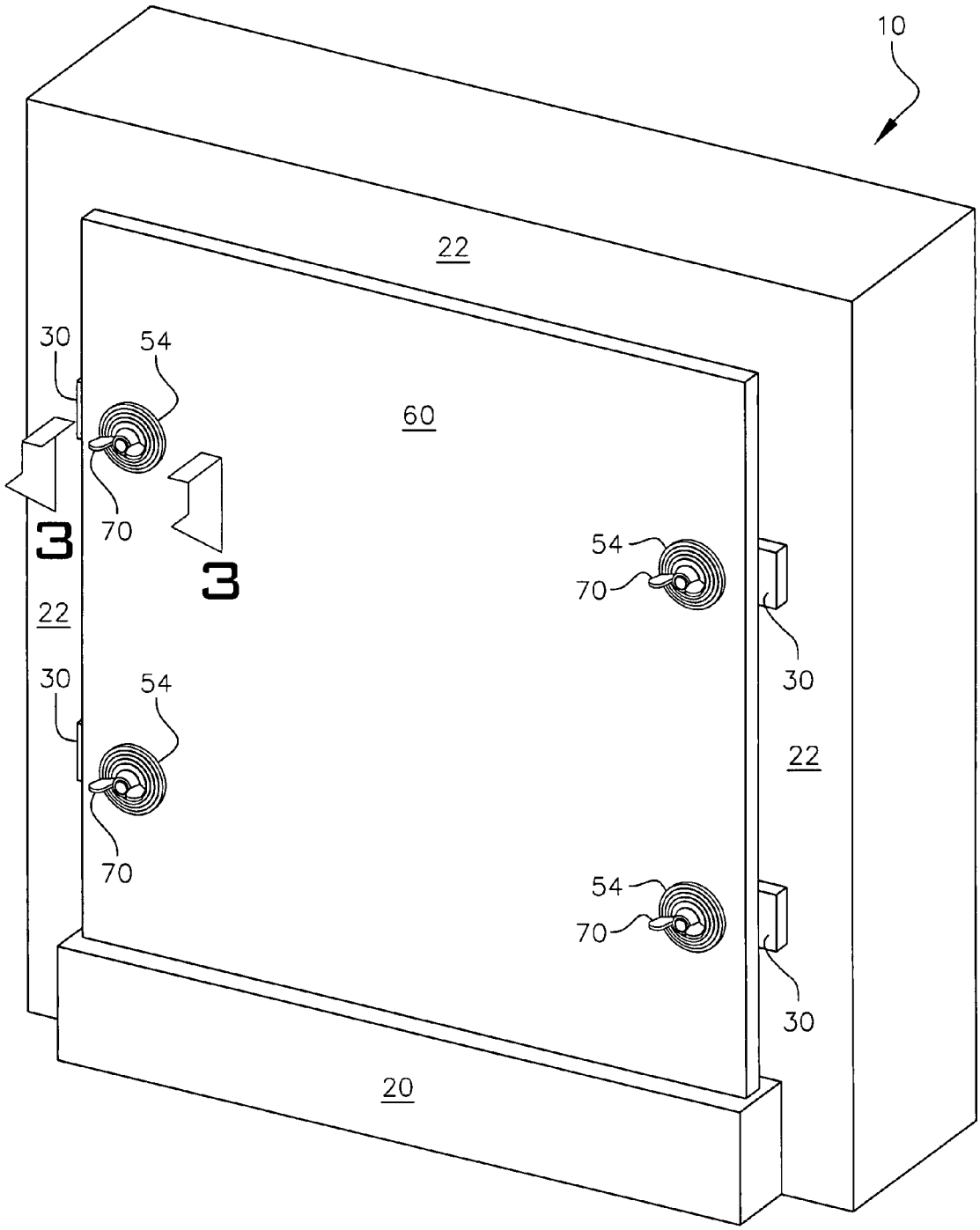
FIG. 2 is a perspective view depicting a sheet of high impact plastic disposed in protective relation to a window and held in position by the novel clamps and brackets.

Referring now to FIG. 1, it will there be seen that the environment where the novel structure is installed is denoted as a whole by the reference numeral 10. A window includes upper glass panel 12 mounted in frame 14 and a lower glass panel 16 mounted in frame 18. Reference numeral 20 denotes a windowsill. The two (2) vertically extending and the one (1) horizontally extending surfaces collectively denoted 22 are external walls of the structure. The vertically extending surface denoted 24 that is perpendicular to external walls 22 and perpendicular to the plane of the window is referred to herein as the vertical side wall. It has an unnumbered counterpart on the opposite side of the window opening that can be seen only by its outer edge in this perspective view.

The first step of the novel installation method is to drill a plurality of holes or bores into each vertical sidewall 24. For a window of normal size, two (2) holes are drilled in each vertical sidewall, making a total of four (4) holes per window. Additional holes may be drilled in each vertical sidewall for larger windows.

For a normal-size window, the upper hole in each vertical sidewall 24 is best positioned about a foot from the top of the window opening and the lower hole in each vertical sidewall is best positioned about a foot from windowsill 20.

Each hole is preferably drilled with a five-eighths of an inch (⅝") wood or concrete drill bit to a depth of not less than an inch and a half (1.5") but these dimensions are not critical.

Figure 3:
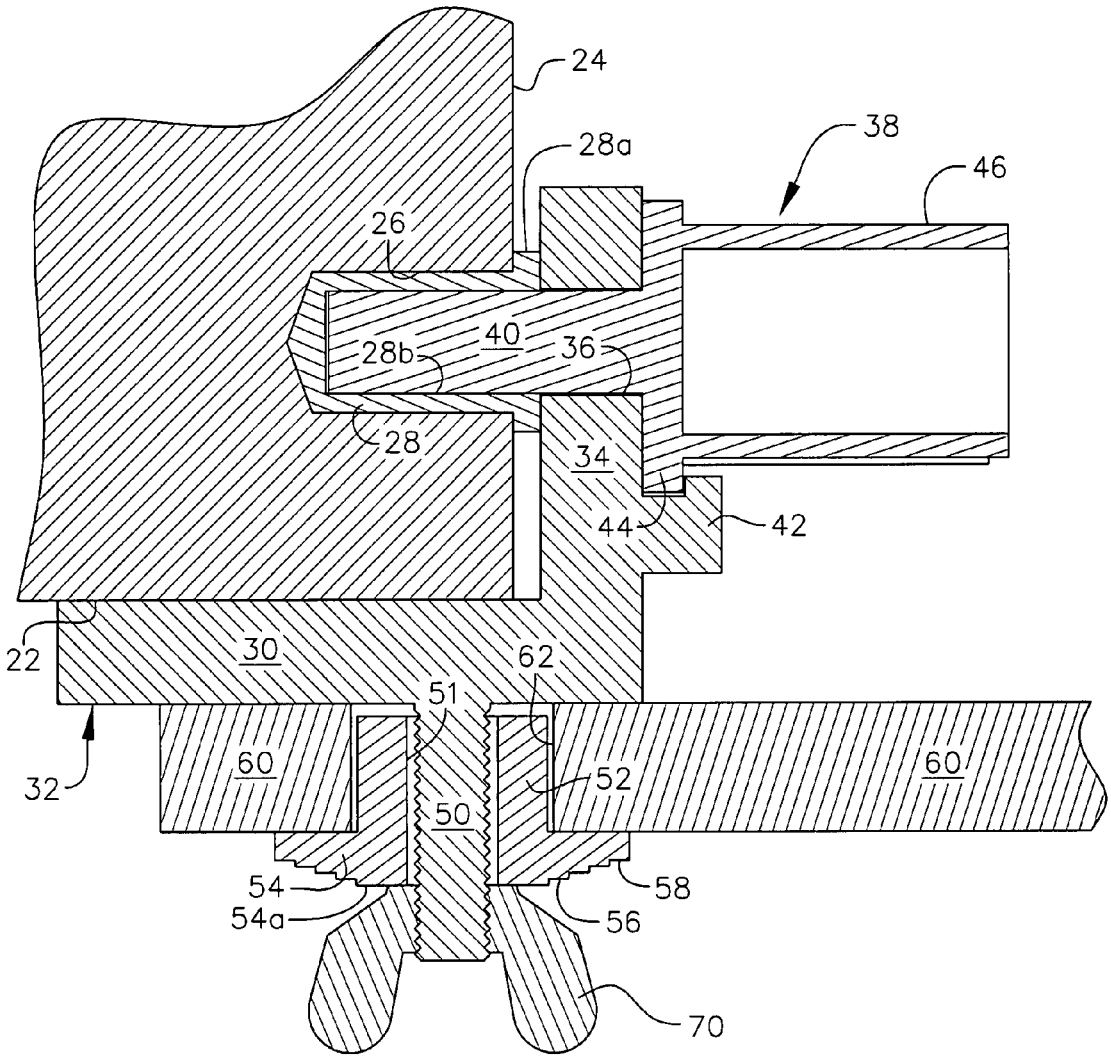
FIG. 3 is a sectional view taken along line 3-3 in FIG. 2.

Each hole is a blind bore as best understood in connection with the horizontal sectional view of FIG. 3 where said hole is denoted 26.

Liner 28 is hammered into its associated hole 26. The steps of drilling the holes and the hammering in of each liner 28, upon being accomplished a first time, are never repeated for that window. Each liner 28 includes a hollow stem and a radially-outwardly-extending flange 28*a* at its trailing end. The exterior surface of the hollow stem is preferably slightly tapered so that it can fit both well-drilled and slightly irregular holes. Lumen 28*b* defined by said hollow stem has a uniform diameter along its extent.

Radially-outwardly-extending flange 28*a* of liner 28 has a predetermined thickness so that said flange 28*a* does not lie flush with vertical sidewall 24.

Base 30 of novel bracket 32 is of substantially rectangular cross-section and of straight configuration. Base 30 abuts and overlies exterior wall 22 when bracket 32 is properly installed as best understood in connection with FIG. 1.

Arm 34 is formed integrally with a first end of base 32 and also has a substantially rectangular cross-section and a straight configuration. Said arm is formed integrally with base 30 and is disposed ninety degrees (90°) relative thereto. Arm 34 therefore overlies and abuts its associated vertical sidewall 24.

As best understood in connection with FIG. 3, said arm is apertured as at 36 to receive pull pin 38. Pull pin 38 includes stem 40 that is received within lumen 28*b* of liner 28.

Cam lock hook 42 is formed integrally with arm 34 and an overhang formed in its distal end captures cam lock 44, which is a radially extending flange formed integrally with pull pin stem 40, when pull pin 38 is rotated into its locked position by manipulation of knurled handle 46. Rotation of pull pin 38, performed by an occupant of the protected structure from within the structure, disengages cam lock 44 from cam lock hook 42 when an opening formed in said flange 44 aligns with the overhang of cam lock hook 42 so that stem 40 of pull pin 38 may be retracted from lumen 28*b*. Withdrawal of said stem from lumen 28*b* disconnects bracket 32 from vertical side wall 24, thereby enabling an occupant of a structure to remove the protective sheet from the window opening and to escape from the structure through said opening if required by a fire, flood, or other calamity affecting the inside of the structure.

Externally threaded stud 50 is formed integrally with base 30 and projects therefrom in perpendicular or upstanding relation thereto.

Sleeve 52 having cap 54 formed integrally therewith collectively form the novel clamp and said parts share a common central bore 51. Accordingly, the novel clamp is disposed in ensleeved relation to threaded stud 50. A sheet of plastic protective material 60 is apertured as at 62 at each threaded stud location and aperture 62 has a diameter slightly greater than the diameter of sleeve 52 but substantially less than the diameter of cap 54.

Cap 54 has a flat center 54*a* with concentric rings of steps formed radially outwardly of said flat center so that radially innermost annular step 56 is spaced further from plastic sheet 60 than radially outermost step 58. This concentric ring of steps imparts flexibility to cap 54 so that it may flex when tightened without breaking.

Threaded stud 50 has a length or height greater than the length of common bore 51 formed in the clamp. Wing nut 70, or other suitable nut, screwthreadedly engages threaded stud 50 and bears against flat central part 54*a* of cap 54 when advanced. Tightening wing nut 70 thus tightens cap 54 to plastic sheet 60 and thus tightens plastic sheet 60 to base 30 of bracket 32.

After a storm has passed, wing nut 70 and the one-piece sleeve 52 and cap 54 are unscrewed from threaded stud 50 at each threaded stud location. Sheet of plastic 60 is then removed. Each pull pin 38 is disengaged from its lumen 28*b* of liner 28 and each bracket 32 is removed.

Plastic sheet 60 therefore bears against base 30 of bracket 32 when wing nut 70 is tightened. Sheet 60 is thus spaced apart from the window, in parallel relation thereto. Bracket 32 relieves all stress from the window frame. More particularly, bracket 32 transfers the positive wind load from the window frame to the exterior wall of the structure.

This invention employs a sheet of high impact plastic instead of plywood. Plastic is lighter in weight and therefore easier to install. Moreover, it protects the window at least as well as plywood. High impact plastic is used herein as an exemplary protective material due to its ready availability. However, this invention is not restricted to plastic as the wind-resistant, protective material. Any other sheet material, whether metallic or non-metallic, having the ability to protect a window from high winds is well within the scope of this invention. The terms "plastic" or "high impact plastic" are thus understood as being used without limiting the scope of the invention.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An apparatus for protecting from high winds a window that is mounted in a window opening in recessed relation to an exterior surface of a structure, said window opening including a pair of laterally opposed vertical sidewalls, comprising:

an "L"-shaped bracket having a base and an arm integrally formed with one another, said base and arm being disposed in perpendicular relation to one another;

said base adapted to be positioned into overlying relation to said exterior wall, thereby positioning said arm into overlying relation to a first vertical sidewall;

said arm being secured to said first vertical sidewall;

an externally threaded stud mounted in perpendicular relation to said base;

a clamp including a sleeve and a cap formed integrally with one another;

a common central bore formed in said sleeve and in said cap, said central bore adapted to slidingly receive said threaded stud;

said cap having a diameter substantially greater than a diameter of said threaded stud;

said threaded stud having a length greater than a length of said common central bore;

an aperture formed in a sheet of protective material, said aperture having a diameter slightly greater than the diameter of said sleeve but substantially less than the diameter of said cap;

said sheet of protective material being positioned into overlying relation to said exterior surface of said structure by aligning said aperture formed in said sheet of protective material with said first threaded stud and centering said first threaded stud within said aperture;

said sleeve and cap being slideably received over said threaded stud;

a nut adapted to screwthreadedly engage said threaded stud;

said nut adapted to be advanced so that said nut abuttingly engages and presses against said cap, thereby urging said cap against said sheet of protective material and urging said sheet of protective material against said bracket;

whereby said sheet of protective material is spaced apart from said window, in parallel relation thereto;

whereby said sheet of protective material is maintained in protecting relation to said window by the pressure of said nut applied to said cap, which pressure is applied by said cap to said sheet of protective material; and whereby said bracket relieves all stress from said window frame by transferring the positive wind load from the window to the exterior wall of the structure.

2. The apparatus of claim 1, further comprising:

a blind bore formed in a vertical side wall;

a liner having a hollow lumen and a length slightly less than a depth of said first blind bore;

said liner being inserted into said blind bore;

a pull pin having a stem adapted to be received within said lumen of said liner;

a cam lock formed by a radially outwardly extending flange that is formed integrally with said stem;

a discontinuous opening formed in said flange;

a handle integrally formed with said flange;

a cam lock hook formed integrally with said arm of said bracket so that said cam lock hook forms an overhang adapted to capture said flange;

said cam lock being in a locked position when said flange is captured by said overhang; and said cam lock being unlocked when said opening formed in said flange is aligned with said overhang.

3. The apparatus of claim 2, further comprising:

said cap having a flat center with concentric rings of steps formed radially outwardly of said flat center so that a radially innermost annular step is spaced further from said sheet of protective material than a radially outermost step, said concentric ring of steps imparting flexibility to said cap so that it may flex when tightened without breaking;

whereby said nut is unscrewed from said threaded stud to enable removal of said sheet of protective material; and whereby said arm is removed from said overlying relation to said vertical side wall when said pull pin is disengaged from said lumen of said liner.

4. The apparatus of claim 3, further comprising:

said sheet of protective material being a high impact plastic.

5. A method for protecting from high winds a window that is mounted in a window opening in recessed relation to an exterior wall of a structure, said window opening including a pair of laterally opposed vertical sidewalls that are disposed perpendicular to a plane of the exterior wall and to a plane of the window, comprising the steps of:

dimensioning a sheet of protective material that does not break upon being subjected to high winds so that it has a height and width at least slightly greater than a height and width of said window opening;

providing a first "L"-shaped bracket having a base and an arm integrally formed with one another, said base and arm being disposed in perpendicular relation to one another;

positioning said base into overlying relation to said exterior wall, thereby positioning said arm into overlying relation to a first vertical sidewall;

securing said arm to said vertical sidewall;

mounting an externally threaded stud in perpendicular relation to said base;

providing a clamp including a sleeve and a cap formed integrally with said sleeve;

forming a common central bore in said sleeve and in said cap, said central bore adapted to slidingly receive said threaded stud;

dimensioning said cap to have a diameter substantially greater than a diameter of said threaded stud;

dimensioning said threaded stud to have a length greater than a length of said central bore;

forming a first aperture in said sheet of protective material, said first aperture having a diameter slightly greater than the diameter of said sleeve but substantially less than the diameter of said cap;

positioning said sheet of protective material into overlying relation to said exterior surface of said structure by aligning the first aperture formed in said sheet of protective material with a first threaded stud and centering said first threaded stud within said first aperture;

slideably inserting said sleeve and cap over said threaded stud;

providing a nut adapted to screwthreadedly engage said threaded stud;

advancing said nut so that said nut abuttingly engages and presses against said cap, thereby urging said cap against said sheet of protective material;

whereby said sheet of protective material is spaced apart from said window, in parallel relation thereto;

whereby said sheet of protective material is maintained in protecting relation to said window by the pressure of said nut applied to said cap, which pressure is applied by said cap to said sheet of protective material; and whereby said bracket relieves all stress from said window by transferring the positive wind load from the window to the exterior wall of the structure.

6. The method of claim 5, further comprising the steps of:

drilling a first blind bore into said first vertical side wall;

providing a first liner having a hollow lumen and a length slightly less than a depth of said first blind bore;

inserting said first liner into said first blind bore;

providing a pull pin having a stem adapted to be received within said lumen of said first liner;

providing a cam lock by forming a radially outwardly extending flange with said stem and forming a discontinuous opening in said flange;

providing a handle integrally formed with said flange;

forming a cam lock hook integrally with said arm so that said cam lock hook forms an overhang adapted to capture said flange;

rotating said cam lock into a locked position by rotating said handle of said pull pin until said flange is captured by said overhang of said cam lock hook; and unlocking said cam lock by rotating said handle of said pull pin so that said opening formed in said flange is aligned with said overhang and withdrawing said stem from said lumen of said liner.

7. The method of claim 5, further comprising the steps of:

forming said cap to have a flat center with concentric rings of steps formed radially outwardly of said flat center so that a radially innermost annular step is spaced further from said sheet of protective material than a radially outermost step, said concentric ring of steps imparting flexibility to said cap so that it may flex when tightened without breaking;

whereby said nut is unscrewed from said threaded stud to enable removal of said sheet of protective material; and whereby said arm is removed from said overlying relation to said first vertical sidewall when said pull pin is disengaged from said lumen of said liner.

8. The method of claim 7, further comprising the step of:

providing said sheet of protective material in the form of high impact plastic.

* * * * *